US007053837B2

(12) United States Patent
Il et al.

(10) Patent No.: US 7,053,837 B2
(45) Date of Patent: May 30, 2006

(54) MULTI-LAYERED MULTI-BAND ANTENNA

(75) Inventors: Kwak-Won Il, Daejeon (KR); Seong-Ook Park, Daejeon (KR)

(73) Assignee: Information and Communication University Educational Foundation, Daejeon (KR)

( * ) Notice: Subject to any disclaimer, the term of this patent is extended or adjusted under 35 U.S.C. 154(b) by 0 days.

(21) Appl. No.: 10/983,900

(22) Filed: Nov. 9, 2004

(65) Prior Publication Data

US 2005/0253758 A1 Nov. 17, 2005

(30) Foreign Application Priority Data

May 11, 2004 (KR) ..... 10-2004-0033195

(51) Int. Cl.
*H01Q 1/38* (2006.01)

(52) U.S. Cl. ..... 343/700 MS; 343/702

(58) Field of Classification Search ..... 343/700 MS, 343/702, 846, 767, 770; H01Q 1/38
See application file for complete search history.

(56) References Cited

U.S. PATENT DOCUMENTS 5,307,075 A * 4/1994 Huynh ..... 343/700 MS
5,568,155 A * 10/1996 Tsunekawa et al. .. 343/700 MS
6,650,294 B1 * 11/2003 Ying et al. ..... 343/700 MS

* cited by examiner

*Primary Examiner*—Hoanganh Le
(74) *Attorney, Agent, or Firm*—Staas & Halsey LLP

(57) ABSTRACT

The present invention provides an multi-layered multi-band antenna used for a communication apparatus for a mobile communication service, comprising: a PCB having power supply and ground portions; an upper plane antenna separated from an upper plane of the PCB, the upper plane antenna consisting of a metal conductor having a predetermined pattern formed with a U-shaped slot; an intermediate plane antenna interposed between the upper plane antenna and the PCB in parallel with the upper plane antenna, the intermediate plane antenna consisting of a metal conductor having a predetermined pattern formed with a U-shaped slot; a power supply metal conductor having the one side connected to a power supply portion of the PCB and the other side connected to one side of the intermediate plane antenna; a ground metal conductor having the one side connected to a ground portion of the PCB and the other side connected to one side of the intermediate plane antenna; and a plurality of short-circuiting metal conductors interposed between the upper and intermediate plane antennas to short-circuiting the upper and intermediate plane antennas.

10 Claims, 13 Drawing Sheets

MULTI-LAYERED MULTI-BAND ANTENNA

BACKGROUND OF THE INVENTION

1. Field of the Invention

The present invention relates to an antenna, and more particularly, to a multi-layered multi-band antenna capable of providing a multi-band to a general patch antenna.

2. Description of Related Art

An antenna used for a mobile communication service (for example, antennas attached to a base station, a switch, and a wireless communication apparatus) has a function of receiving electromagnetic waves and externally transmitting electrical signals generated by a communication apparatus.

With increase in the mobile communication service and miniaturization of the mobile communication apparatus, there is limitation to space for the antenna. The space limitation results in difficulty in using a general chip antenna mounted on a patterned ground.

With development of the mobile communication apparatus and increase in user's request for various services, various system services are required. In order to meet these requirements, a combination of various antennas is used.

A conventional U-shaped slot antenna has a single-layered structure. The antenna has been used for the switch or the base station rather than the mobile communication service. The conventional U-shaped slot antenna has a problem in that the antenna is so large not to be suitable for the mobile communication service and the large size thereof results in the increase in the size of the ground. In addition, power supply and ground points of the conventional antenna are not suitable for resonance in a high frequency band for the mobile communication service. That is, the conventional antenna has a problem in that the size of antenna has to be enlarged in order to induce a resonance frequency adaptable to the mobile communication service.

On the other hand, in the antenna market, external antennas are replaced with embedded antennas. The mobile terminals are manufactured by using dual (or multi)-band antenna. Therefore, antennas available for multi-band are required. This is because different nations use different frequency bands and, even in one nation, different services are provided in different frequency bands.

SUMMARY OF THE INVENTION

In order to solve the aforementioned problems, an object of the present invention is to provide an antenna coping with miniaturization of mobile communication apparatuses. In addition, another object of the present invention is to provide an antenna available for a multiplexing service for simultaneously transmitting and receiving multi-channel information.

In order to achieve the objects, according to an aspect of the present invention, there is provided a multi-layered multi-band antenna for a mobile communication apparatus adapting a patch antenna formed by using a ground as a reflecting plate without forming a pattern on the ground. The multi-layered multi-band antenna comprises a multi-layered structure formed by folding front, rear, and side portions of a U-shaped slot antenna, and in order to obtain a good impedance matching point, some or entire ends of the folded portions are shorted-circuited (or not short-circuited) to supply power (FIG. 8*b* is a short-circuited structure, FIG. 7*b* is a not-short-circuited structure, and others are structures where one side of the power supply portion is short-circuited). In addition, upper and intermediate plane antennas are electrically short-circuited by using a plurality of via holes. As a result, one antenna can be used in two or more frequency bands in accordance with user's selection. In addition, the multi-layered structure can be miniaturized to be adapted to the mobile communication apparatus.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Now, the present invention will be described in detail with reference to the accompanying drawings.

Figure 1:
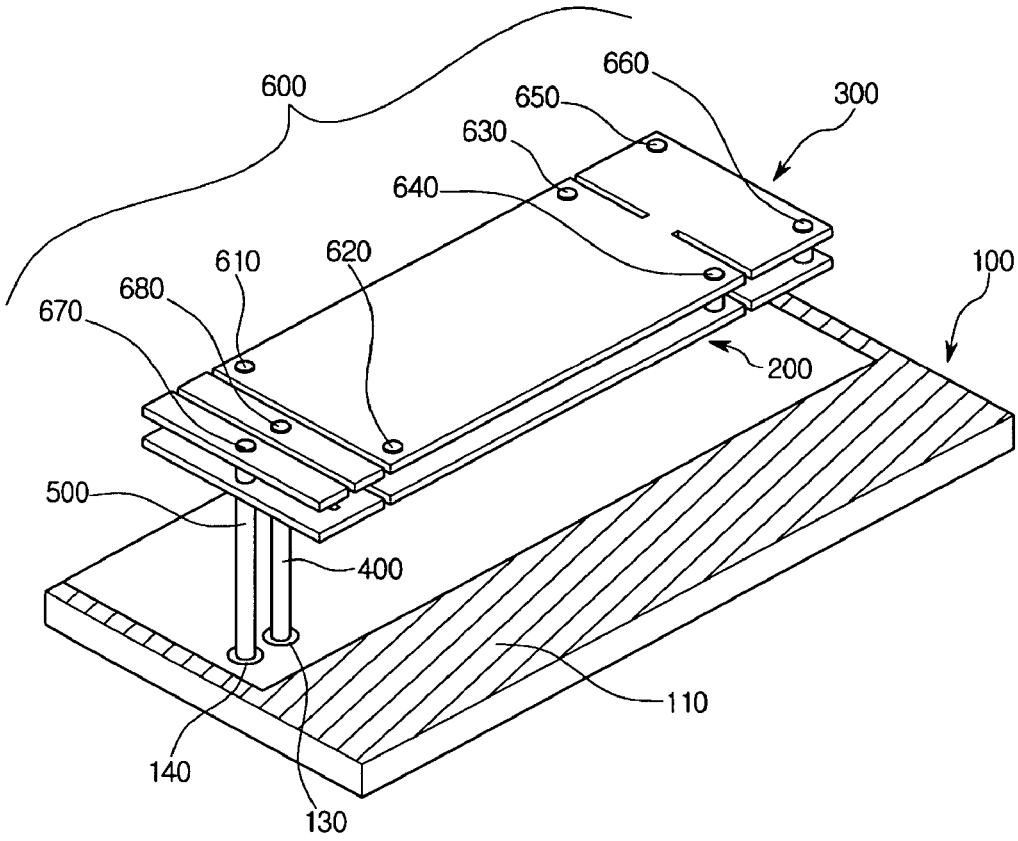
FIG. 1 is a perspective view showing a multi-layered multi-band antenna according to the present invention.

FIG. 1 is a perspective view showing a multi-layered multi-band antenna according to a first embodiment of the present invention. As shown in FIG. 1, the multi-layered multi-band antenna comprises a printed circuit board (PCB) 100, an intermediate plane antenna 200, an upper plane antenna 300, a power supply metal conductor 400, a ground metal conductor 500, and a plurality of short-circuiting metal conductors 600.

Over one side of the PCB 100, the intermediate plane antenna 200 and the upper plane antenna 300 are disposed to be separated from each other by a predetermined gap. The intermediate and upper plane antennas 200 and 300 are antennas where U-shaped slots are provided. FIG. 1 exemplifies a construction where a solid-state dielectric member interposed between the intermediate and upper plane antennas 200 and 300 supports the intermediate and upper plane antennas 200 and 300. In this construction, the intermediate and upper plane antennas 200 and 300 are constructed in a multi-layered structure where front, rear, and side planes of the antennas are not connected as shown in FIG. 1. Since the intermediate and upper plane antennas 200 and 300 are not connected at the front, rear, and side planes thereof, the plurality of short-circuiting metal conductors 600 are needed between the intermediate and upper plane antennas 200 and 300. The short-circuiting metal conductors 600 also have a function of supporting the intermediate and upper plane antennas 200 and 300. The number of the short-circuiting metal conductors 600 depends on the shape of the antenna determined in accordance with the slots of the intermediate and upper plane antennas 200 and 300. In the present invention, the short-circuiting metal conductors 600 includes 8 short-circuiting metal conductors 610, 620, 630, 640, 650,660, 670, and 680 which connect the intermediate and upper plane antennas 200 and 300 bypassing through the dielectric member interposed between the intermediate and upper plane antennas 200 and 300.

On the other hand, an air layer may be interposed between the intermediate and upper plane antennas 200 and 300. In this case, font and rear side antennas (not shown) formed by folding the font and rear sides of the upper plane antenna 300 are connected to the intermediate plane antenna 200. Otherwise, font, rear, left and right side antennas (not shown) formed by folding the font, rear, left, and right sides of the upper plane antenna 300 are connected to the intermediate plane antenna 200. In these constructions, since the intermediate and upper plane antennas 200 and 300 are supported and short-circuited by the font, rear, left and right side antennas, additional short-circuiting metal conductors may be unnecessary.

The power supply and ground are provided by the power supply and ground metal conductors 400 and 500, respectively. The power supply structure is a CPW (co-planar waveguide) or a microstrip line, which is formed on the PCB 100 to perform the power supply by short-circuiting the power supply metal conductor 400 and a power supply metal plate 130 electrically connected to a signal line (directly extended from the an RF module) to the intermediate plane antenna 200. The power supply metal conductor 400 is inserted and connected into a cylindrical via hole formed by puncturing one side of the intermediate plane antenna 200 in a shape of a cylinder and plating an inner surface of the cylinder with a conductive metal. The ground metal conductor 500 has a similar structure to the power supply metal conductor 400.

In addition, connection between the power supply and ground portions are obtained by short-circuiting front and rear parts of the intermediate plane antenna 200 which the power supply and ground metal conductors 400 and 500 are connected. Here, one metal conductor out of the short-circuiting metal conductors at the front and rear parts may be selectively removed without change of characteristics of the antenna. In addition, without short-circuiting the front and rear parts of the intermediate plane antenna 200, the front or rear part of the upper plane antenna 300 may be short-circuited. If widths of the front and rear short-circuiting metal conductors at the intermediate plane antenna 200 increase, a capacitive component of an input impedance is reduced so that resonance characteristics can be improved but the associated bandwidth decreases. On the other hand, if lengths of the metal conductors between the power supply and ground metal conductors 400 and 500 decrease (when the separation gap between the power supply and ground portions of the antenna is related to an electrically capacitive value due to metal patterns), there occurs the same phenomenon as the case of increasing the widths of the front and rear short-circuiting metal conductors of the intermediate plane antenna 200. Like this, in the present invention, the power supply structure can be adapted in accordance with usage environments.

Figure 2:
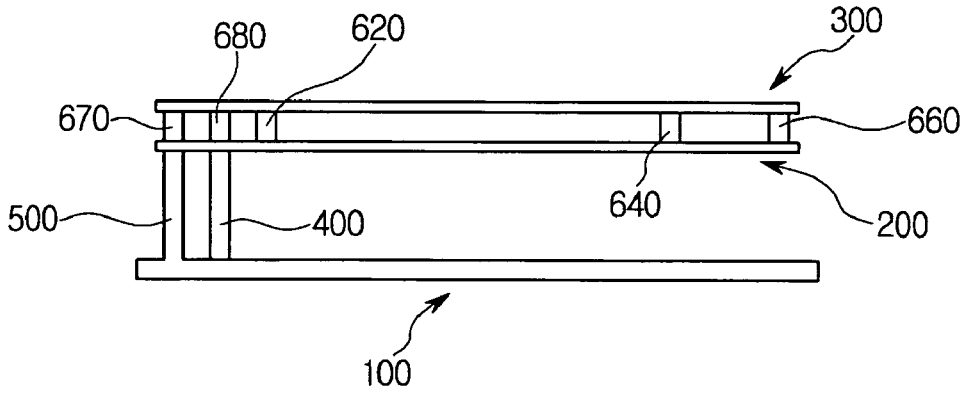
FIG. 2 is a front view showing a multi-layered multi-band antenna according to a first embodiment of the present invention.

FIG. 2 is a front view showing a multi-layered multi-band antenna according to the present invention. As shown in FIG. 2, the power supply and ground of the intermediate plane antenna 200 separated from the PCB 100 are implemented with the power supply and ground metal conductors 400 and 500, respectively. The intermediate and upper plane antennas 200 and 300 are supported and short-circuited by the short-circuiting metal conductors 620, 640, 660, 670, and 680. Here, the short-circuiting metal conductors 670 and 680 provided between the intermediate and upper plane antennas 200 and 300 may be formed with extended portions of the power supply and ground metal conductors 400 and 500 which are provided under the intermediate and upper plane antennas 200 and 300, respectively. On the other hand, a solid-state dielectric member 700 may be interposed between the intermediate and upper plane antennas 200 and 300.

Figure 3:
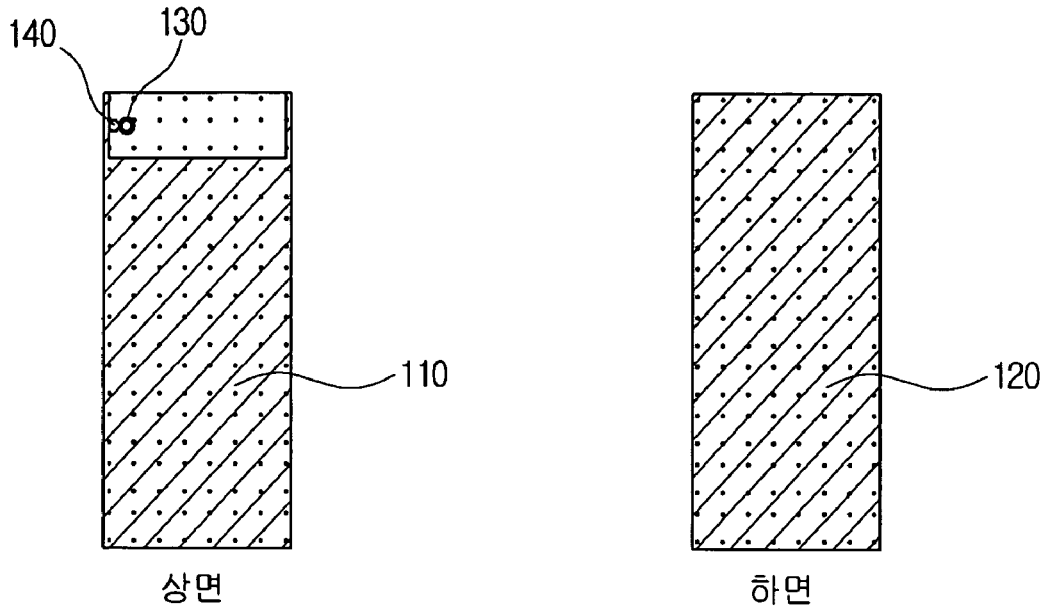
FIG. 3 is a view showing upper and lower planes of a PCB adapted to the present invention.

FIG. 3 is a view showing upper and lower planes of a PCB adapted to the present invention. As shown in FIG. 3, the PCB 100 comprises the power supply and ground metal plates 130 and 140 to which the power supply and ground metal conductors 400 and 500 at the antenna positions are connected. Upper and lower planes 110 and 120 of the PCB 100 are plated with a metal in order to be used for ground. In design of a general embedded antenna, metal conductors at ground portions around the antenna are removed. However, in an antenna according to the present invention, the metal conductors at the ground portions are not removed. Since the metal conductors at the ground portions are not removed, it is possible to ensure spaces for circuit devices such as microphone and earphone jacks between the antenna and the metal conductors of the upper plane 110 of the PCB 100. In addition, since metal conductors of the upper plane 110 of the PCB 100 can be used as a reflecting plate, it is possible to improve antenna efficiency and to reduce absorption rate of electromagnetic waves which affect human bodies.

Figure 4A:
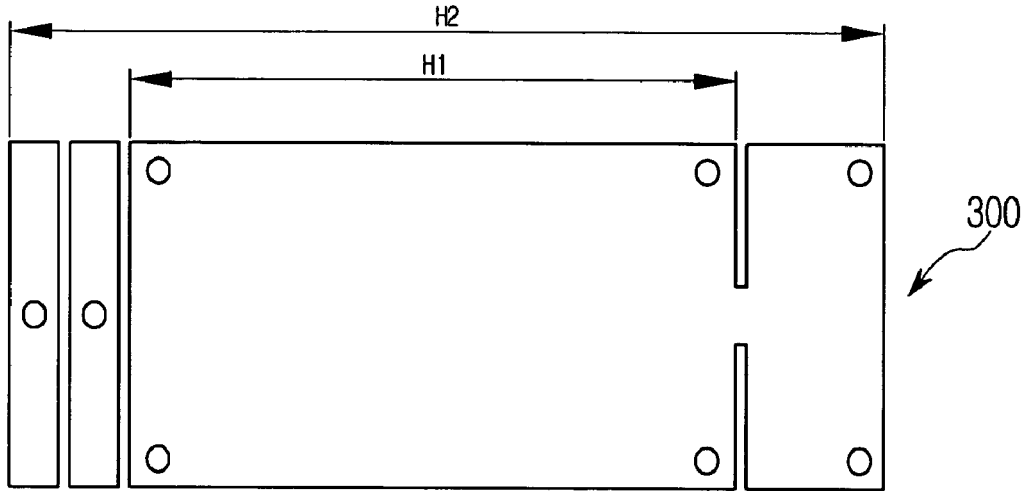
FIGS. 4*a* and 4*b* are views showing shapes of radiation patches of an antenna according to the present invention.
Figure 4B:
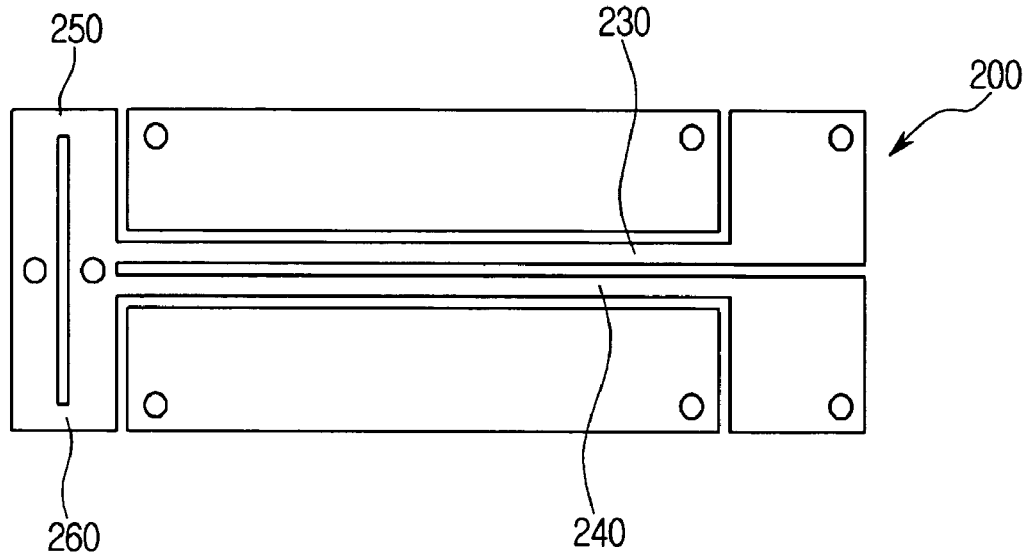

FIGS. 4*a* and 4*b* are views showing shapes of radiation patches of an antenna according to the present invention. FIG. 4*a* is a plane view of the upper plane antenna 300 which is a radiation patch provided with a U-shaped slot. The upper plane antenna 300 is provided with a plurality of via holes to which the short-circuiting metal conductors are inserted or a plurality of grooves of which upper portions are closed.

FIG. 4*b* is a plane view of the intermediate plane antenna 200 which is a radiation patch provided with a U-shaped slot. The intermediate plane antenna 200 is provided with a plurality of via holes which the short-circuiting metal conductors are inserted into or a plurality of grooves of which lower portions are closed. Here, front and rear parts of the radiation patch to which the power supply and ground metal conductors are connected are directly short-circuit.

Figure 5:
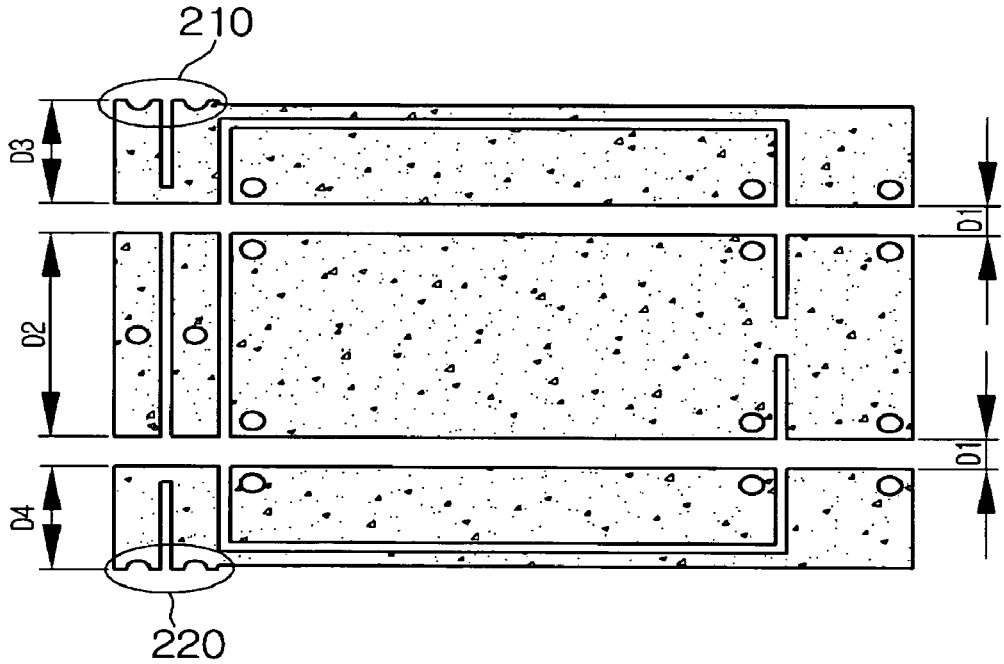
FIG. 5 is a development view showing a radiation patch of an antenna according to the present invention.

FIG. 5 is a development view showing a radiation patch of an antenna according to the present invention. As shown in FIG. 5, a portion indicated by an interval D1 induces an electrical short-circuit between intermediate and upper plane antennas. In a case where a rectangular-parallelepiped dielectric member is adapted, the interval D1 is a thickness of the dielectric member. A portion indicated by an interval D2 is a metal conductor constituting the upper plane antenna. Portions indicated by intervals D3 and D4 are metal conductors constituting the intermediate plane antenna. Coupling grooves 210 and 220, to which the power supply and ground metal conductors are coupled, are electrically short-circuited with a patch of a power supply portion of the U-shaped slot patch antenna.

As shown in FIG. 5, the antenna of the present invention incorporates a structure of the U-shaped slot patch antenna in order to induce multi-band resonance. In addition, the antenna is miniaturized in order to increase a wavelength in an operational frequency band and improve characteristics. In addition, the front and rear portions of the antenna are folded and layered in order to obtain a good impedance matching point. Moreover, in addition to the multi-layered structure formed by folding the front and rear portions of the antenna, end portions of the folded metal conductors are electrically connected to each other. In addition, the antenna of the present invention is different from a U-shaped slot patch antenna in terms of power supply and ground points. In addition, the antenna of the present invention is miniaturized by about ⅓ of the size of the U-shaped slot patch antenna.

On the other hand, the present invention uses via holes in order to be adapted to the mobile communication server. The via holes are formed by puncturing the upper and intermediate planes of the antenna in a shape of a cylinder and plating a metal on an inner surface of the cylinder. The via holes are electrically short-circuited to metal conductors of the upper and intermediate plane antennas. However, the structure using the via hole according to the present invention is adapted to a case where the antenna includes a solid-state rectangular-parallelepiped dielectric member. Therefore, in a case where an air layer is interposed between the upper and intermediate plane antennas, the upper and intermediate plane antennas may be simply electrically short-circuited without the via holes. In addition, since the object of the via holes is to electrically short-circuit the upper and intermediate plane antennas, the via holes may have a shape of a semi-circle rather than the cylinder.

As shown in FIG. 5, the structure of the antenna of the present invention may be modified for various uses. The antenna may have a structure available for a multiplexing service where multi-channel information constructed in different wavelengths can be simultaneously transmitted.

In addition, in the general embedded antenna, the resonance frequency may not match with a desired frequency due to design and manufacturing errors. Therefore, there is needed a tuning process for adjusting the resonance frequency to the desired frequency. The antenna of the present invention has a structure capable of selecting plural tuning points.

Figure 6A:
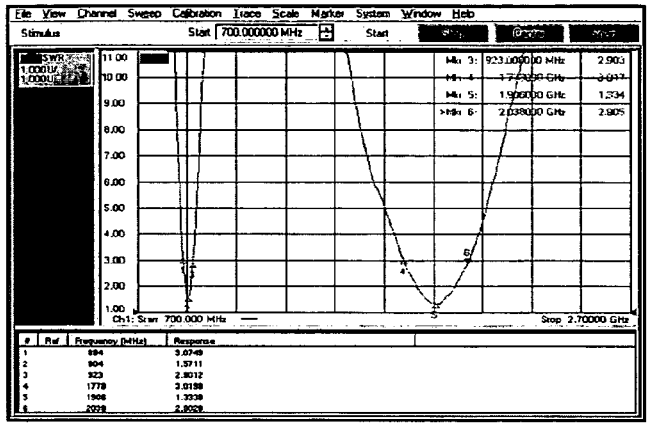
FIG. 6*a* is a graph showing characteristics of the antenna having the construction of FIG. 5.
Figure 6B:
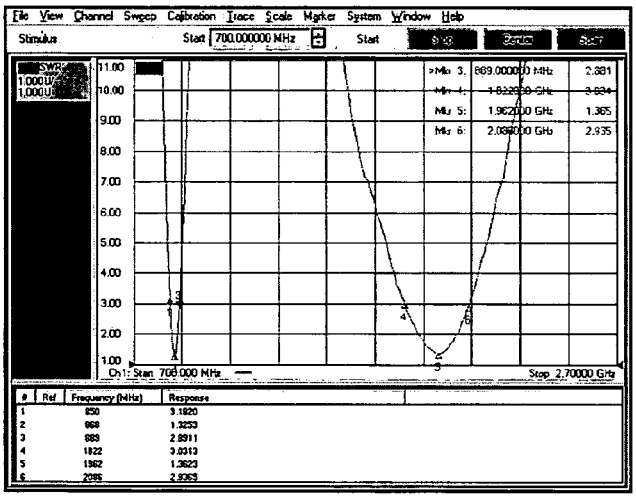
FIG. 6*b* is a graph showing characteristics of an antenna constructed by exchanging an upper plane antenna for an intermediate plane antenna in FIG. 5.

FIG. 6*a* is a graph showing characteristics of the antenna having the construction of FIG. 5. In addition, FIG. 6*b* is a graph showing characteristics of an antenna constructed by exchanging an upper plane antenna for an intermediate plane antenna in FIG. 5. Here, the characteristics of the antenna is measured with Agilent E8357A (300 kHz~6 GHz) PNA Series Network Analyzer.

As the interval between the upper plane antenna and the metal conductor on the PCB is apart from each other, the resonance frequency in the low frequency band shifts to low frequency. On the other hand, as the interval between the intermediate plane antenna and the metal conductor on the PCB is close to each other, the resonance frequency in the high frequency band shifts to low frequency. The characteristics of the resonance frequency shift depending on the intervals between the upper and intermediate planes of the PCB and the antenna are similar to characteristics of a resonance induction of a general patch antenna. In addition, as the thickness of the solid-state rectangular-parallelepiped dielectric member or air layer interposed between the upper and intermediate plane antennas increases, the resonance frequency of the antenna shifts to low frequency. As the dielectric constant of the dielectric member increases, the antenna is further miniaturized but its efficiency and radiation gain are lowered.

In FIG. 4*a*, the lengths H1 and H2 indicate overall sizes of the upper plane antenna. As the size of the antenna increases, the resonance frequency of the antenna shifts to low frequency. As the length H1 increases, the resonance frequency of the antenna shifts to low frequency. As the length H2 increases, the resonance frequency of the antenna also shifts to low frequency. However, in a case where the change of the lengths H1 and H2 is not completely proportional to the change of characteristics (resonance frequency shift), the high resonance frequency is divided so that the resonance can be induced in further multi-band.

In FIG. 4*b*, the metal conductors 230 and 240 are sensitive to the resonance characteristics in a 1 GHz or lower band. As the widths of the metal conductors 230 and 240 decrease, the resonance frequency in the 1 GHz or lower band shifts to low frequency. On the contrary, as the widths of the metal conductors 230 and 240 increase, the resonance frequency in the 1 GHz or lower band shifts to high frequency.

In FIG. 4*b*, the power supply and ground portions of the antenna are connected to each other by using metal conductors 250 and 260 of the intermediate plane antenna. One of the metal conductors 250 and 260 can be selectively removed without change of characteristics. In addition, in a case where both of the metal conductors 250 and 260 of the intermediate plane antenna are removed and the power supply and ground portions of the upper plane antenna are connected in the same manner as the intermediate plane antenna, there is no change of characteristics. However, if the widths of the metal conductors 250 and 260 of the intermediate plane antenna increase, the capacitive component of the input impedance is reduced so that resonance characteristics can be improved but the associated bandwidth decreases. On the other hand, if lengths of the metal conductors between the power supply and ground metal conductors 400 and 500 decrease (when the separation gap between the power supply and ground portions of the antenna is related to an electrically capacitive value due to metal patterns), there occurs the same phenomenon as the case of increasing the widths of the metal conductors 250 and 260 of the intermediate plane antenna 200. Like this, in the present invention, the power supply structure can be adapted to usage environments.

FIGS. 7*a* to 7*e* are plan views, development views, characteristic change graphs of upper and intermediate plane antennas according to a second embodiment of the present invention.

Figure 7A:
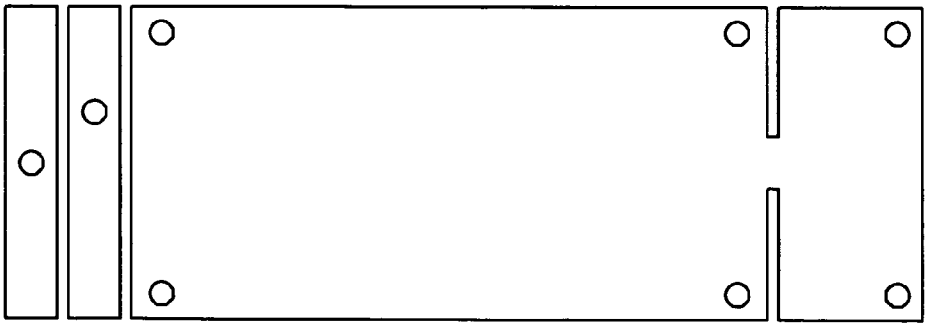
FIGS. 7*a* to 7*e* are plan views, development views, characteristic change graphs of upper and intermediate plane antennas according to a second embodiment of the present invention.
Figure 7B:
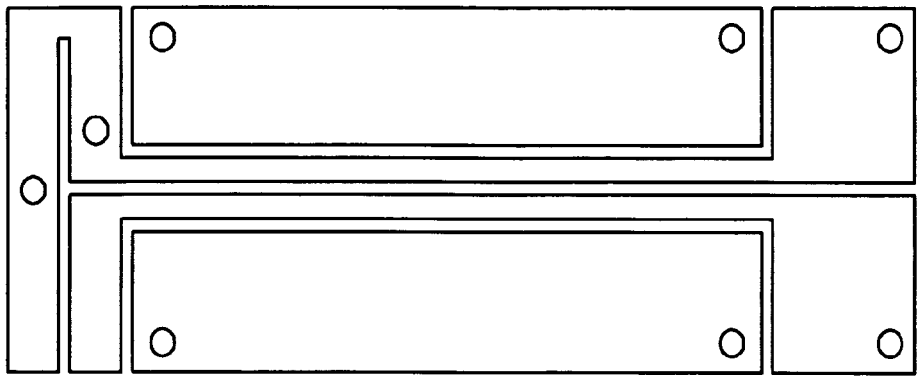
Figure 7C:
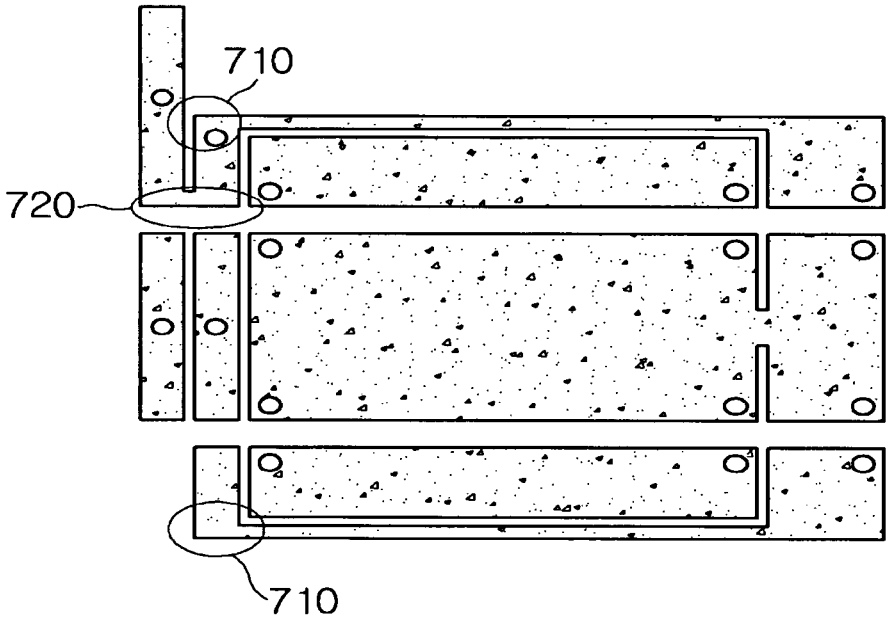

As shown in FIGS. 7*a* to 7*c*, the second embodiment is different from the first embodiment in terms of design of power supply and ground points. In addition, the second embodiment is different from the first embodiment in terms of structures of the metal conductors 250 and 260 of the intermediate plane antenna, which is described above with respect to the first embodiment. With respect to the design difference of the power supply and ground points, the intermediate plane antenna is not simultaneously short-circuited to the power supply metal conductor like power supply portions 710, but there is provided an inverted-F input stage where the power supply metal conductor is connected to the ground metal conductors via a metal conductor 720 of the intermediate plane antenna.

Figure 7D:
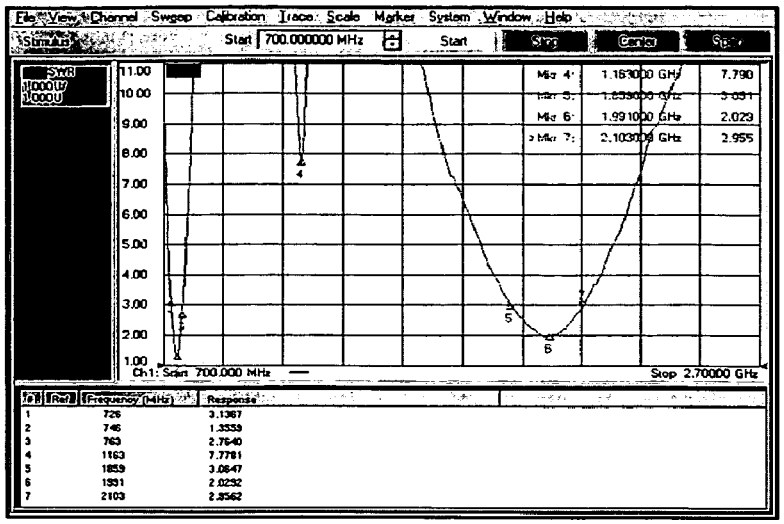
Figure 7E:
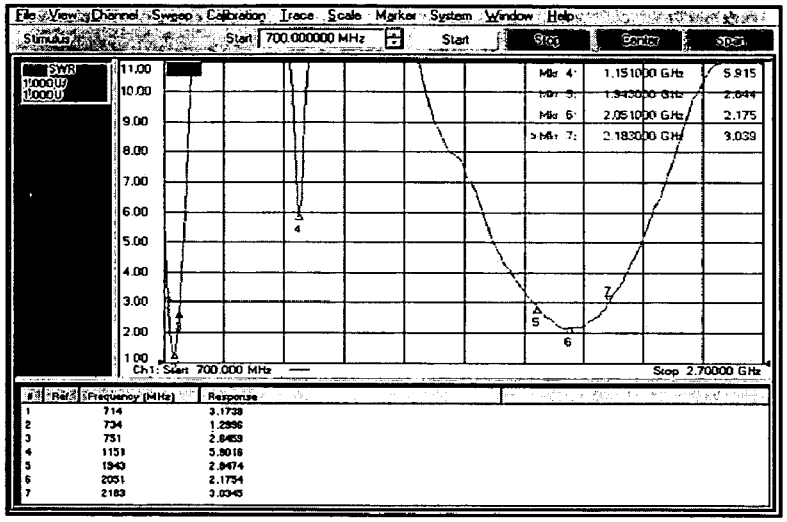

FIGS. 7*d* and 7*e* show changes of characteristics in the second embodiment. FIG. 7*d* shows characteristics of the antenna having a structure of FIG. 7*c*. FIG. 7*e* shows characteristics of the antenna where the upper and intermediate plane antennas of FIG. 7*c* exchanges positions thereof. As shown in FIGS. 7*d* and 7*e*, the resonance frequencies in the low and high frequency bands of FIG. 7*e* shifts to lower and higher frequency than that of FIG. 7*d*, respectively.

FIGS. 8*a* to 8*e* are plan views, development views, characteristic change graphs of upper and intermediate plane antennas according to a third embodiment of the present invention.

Figure 8A:
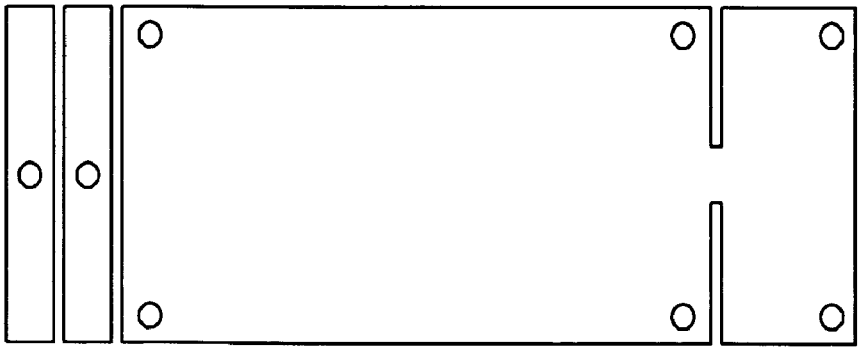
FIGS. 8*a* to 8*e* are plan views, development views, characteristic change graphs of upper and intermediate plane antennas according to a third embodiment of the present invention.
Figure 8B:
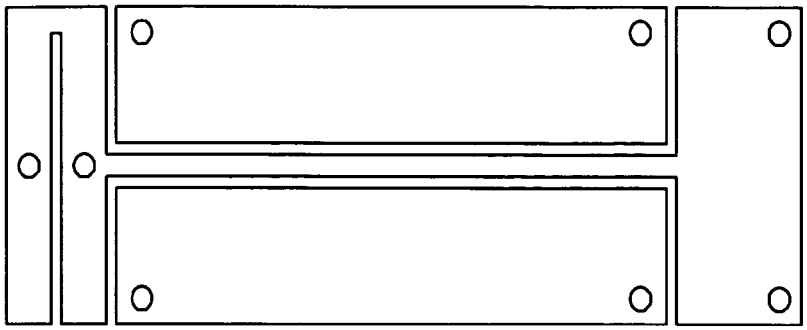
Figure 8C:
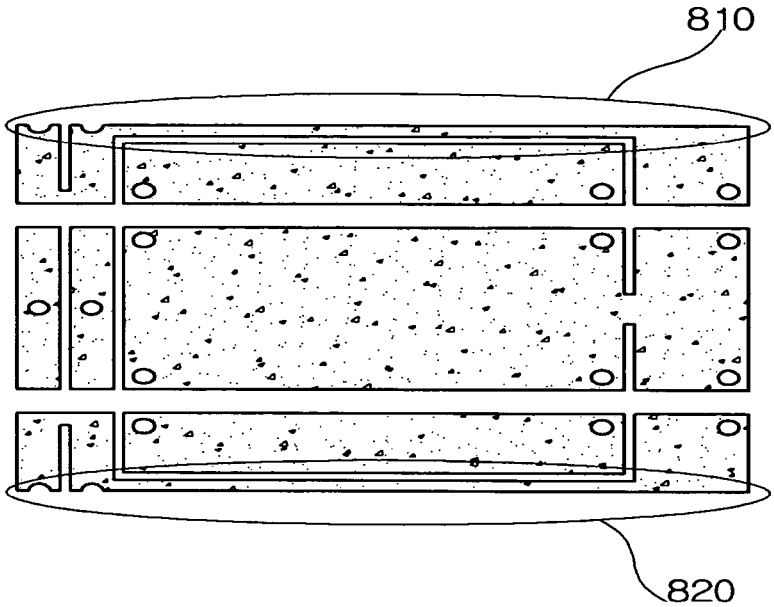

As shown in FIGS. 8*a* to 8*c*, the third embodiment is different from the first embodiment in terms of design of power supply and ground points. In the first embodiment, in order to adjust bandwidths and obtain a good impedance matching point, slots are formed in the metal conductors between the power supply and ground points, and the antenna characteristics are adjusted with the slots between the power supply and ground points. However, in the third embodiment, the bandwidths are adjusted with not the slots but an inverted-F input stage. On the other hand, in the first embodiment, the power supply patches of the U-shaped slot patch antenna are electrically short-circuited to the coupling grooves of the intermediate plane antenna. However, in the third embodiment, the entire outside portions of the U-shaped slot patch antenna is electrically short-circuited by using metal conductors 810 and 820 of the intermediate plane antenna.

Figure 8D:
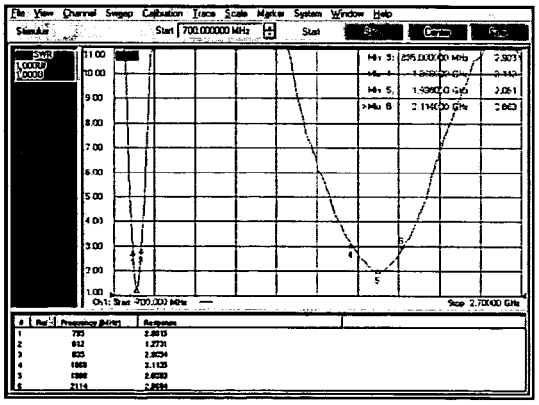
Figure 8E:
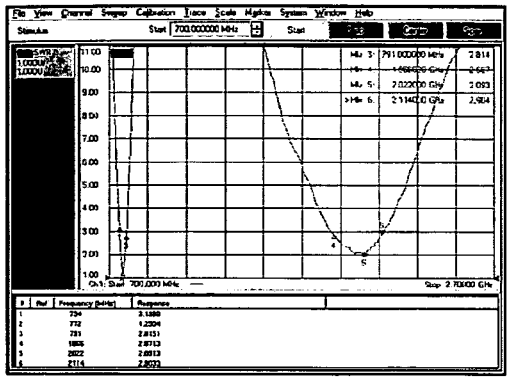

FIGS. 8*d* and 8*e* show changes of characteristics in the third embodiment. FIG. 8*d* shows characteristics of the antenna having a structure of FIG. 8*c*. FIG. 8*e* shows characteristics of the antenna where the upper and intermediate plane antennas of FIG. 8*c* exchanges positions thereof. As shown in FIGS. 8*d* and 8*e*, the resonance frequency in the low frequency band of FIG. 7*e* shifts to lower frequency than that of FIG. 8*d*.

FIGS. 9*a* to 9*e* are plan views, development views, characteristic change graphs of upper and intermediate plane antennas according to a fourth embodiment of the present invention.

Figure 9A:
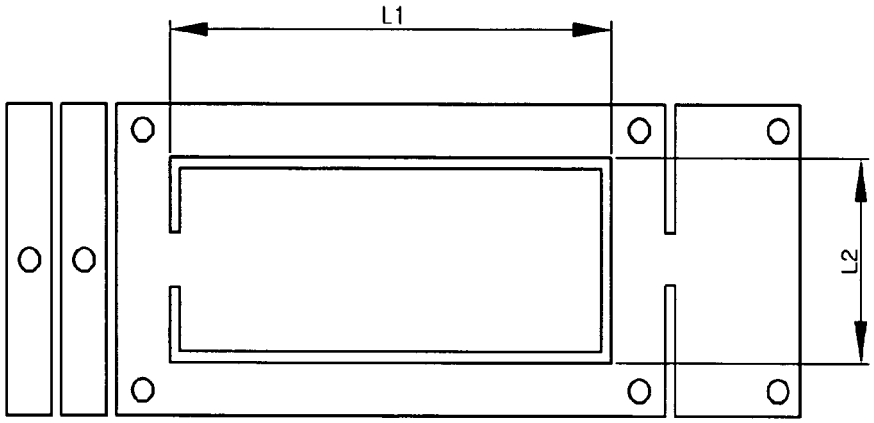
FIGS. 9*a* to 9*e* are plan views, development views, characteristic change graphs of upper and intermediate plane antennas according to a fourth embodiment of the present invention.
Figure 9B:
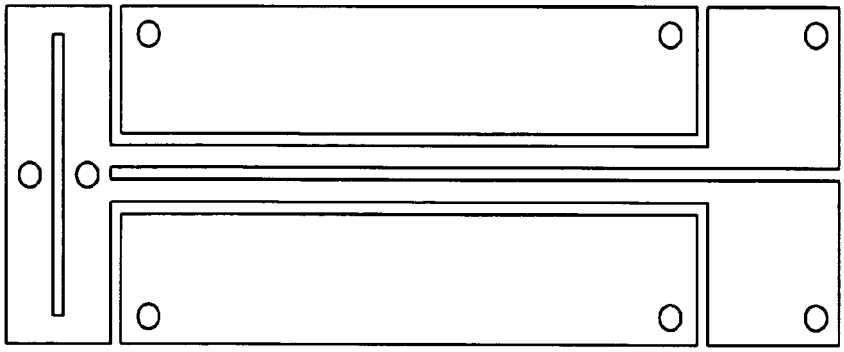
Figure 9C:
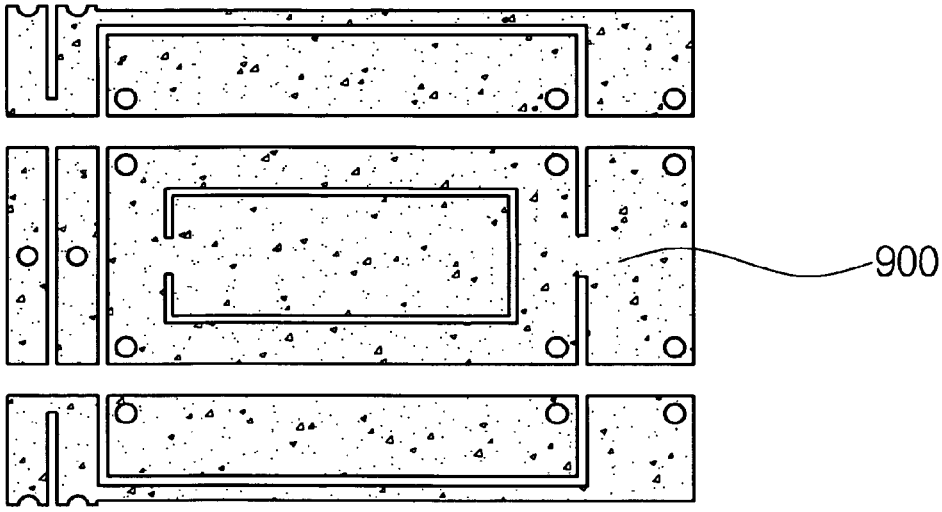

As shown in FIGS. 9*a* to 9*c*, in the fourth embodiment, an additional U-shaped slot 900 is provided at the central portion of a U-shaped slot upper plane antenna. The addition of the U-shaped slot 900 results in increase in one resonance frequency in a mobile communication serer available band. The decease in the lengths L1 and L2 of the metal conductors results in shift of the intermediate resonance frequency out of three resonance frequencies into a high frequency band. On the contrary, the increase in the lengths L1 and L2 of the metal conductors results in shift of the intermediate resonance frequency out of three resonance frequencies into a low frequency band.

Figure 9D:
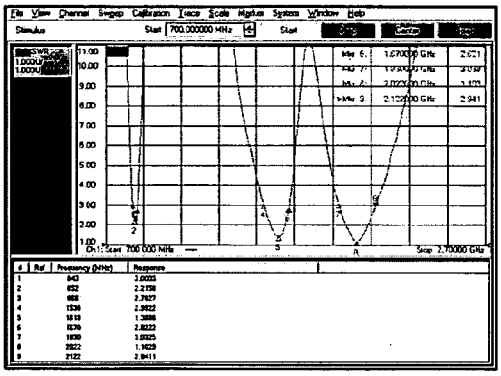
Figure 9E:
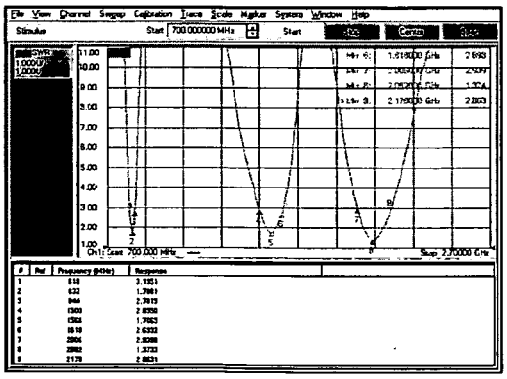

FIGS. 9*d* and 9*e* show changes of characteristics in the fourth embodiment. FIG. 9*d* shows characteristics of the antenna having a structure of FIG. 9*c*. FIG. 9*e* shows characteristics of the antenna where the upper and intermediate plane antennas of FIG. 9*c* exchanges positions thereof. As shown in FIGS. 9*d* and 9*e*, the resonance frequency in the low frequency band of FIG. 9*e* shifts to lower frequency than that of FIG. 9*d*. In addition, the resonance frequencies in the two high frequency bands shift to high frequency.

FIGS. 10*a* to 10*e* are plan views, development views, characteristic change graphs of upper and intermediate plane antennas according to a fifth embodiment of the present invention.

Figure 10A:
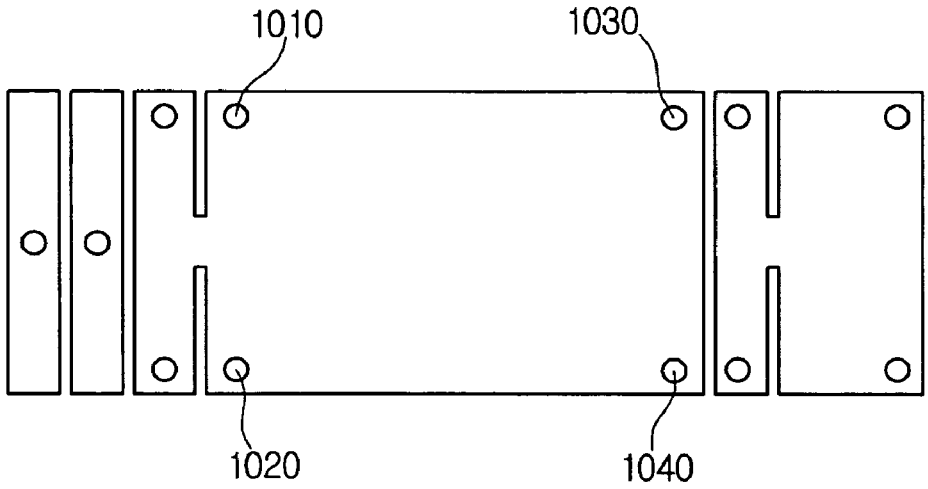
FIGS. 10*a* to 10*e* are plan views, development views, characteristic change graphs of upper and intermediate plane antennas according to a fifth embodiment of the present invention.
Figure 10B:
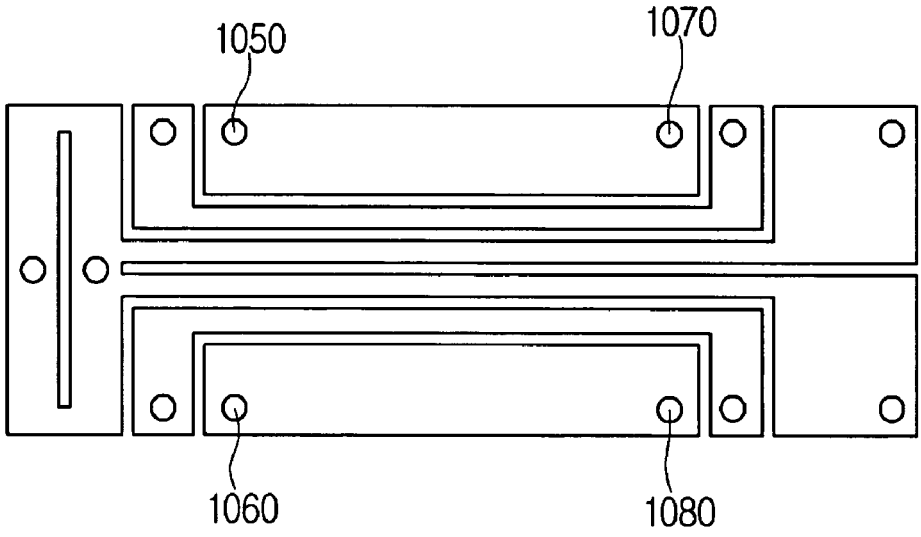
Figure 10C:
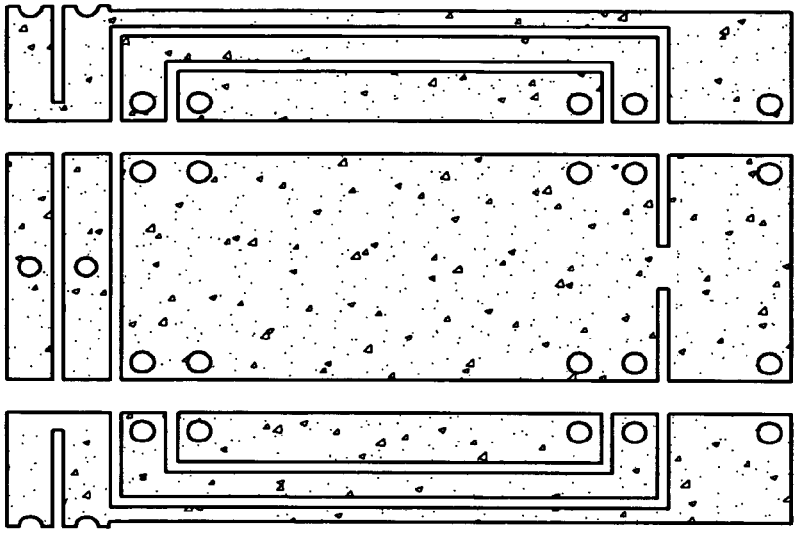

As shown in FIGS. 10*a* to 10*c*, in the fifth embodiment, the intermediate plane antenna as well as the upper plane antenna is used in order to enlarge the inverted-U shaped slot of the antenna according to the fourth embodiment. In order to electrically short-circuit the upper and intermediate plane antennas, there are added a plurality of via holes 1010 to 1080 formed by puncturing the upper and intermediate plane antennas in a shape of a cylinder and plating an inner surface of the cylinder with a metal.

Figure 10D:
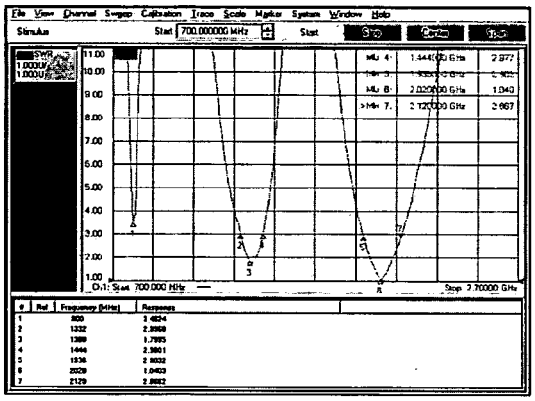
Figure 10E:
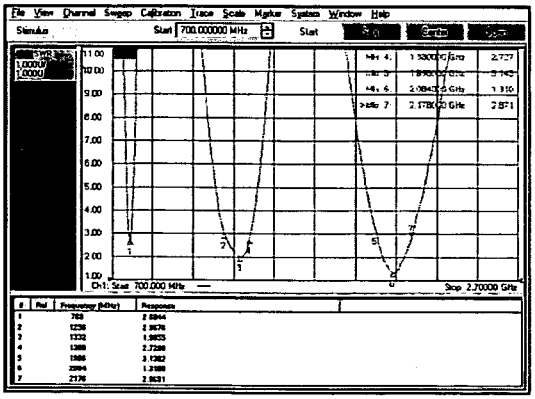

FIGS. 10*d* and 10*e* show changes of characteristics in the second embodiment. FIG. 10*d* shows characteristics of the antenna having a structure of FIG. 10*c*. FIG. 10*e* shows characteristics of the antenna where the upper and intermediate plane antennas of FIG. 10*c* exchanges positions thereof. As shown in FIGS. 10*d* and 10*e*, the resonance characteristics of FIG. 10*e* are better than those of FIG. 10*d*. With respect to shift of the intermediate resonance frequency, the resonance frequency of FIG. 10*e* is lower than that of FIG. 10*d*. With respect to the resonance frequency in a high frequency band, the resonance frequency of FIG. 10*d* is lower than that of FIG. 10*e*.

FIGS. 11*a* to 11*e* are plan views, development views, characteristic change graphs of upper and intermediate plane antennas according to a sixth embodiment of the present invention.

Figure 11A:
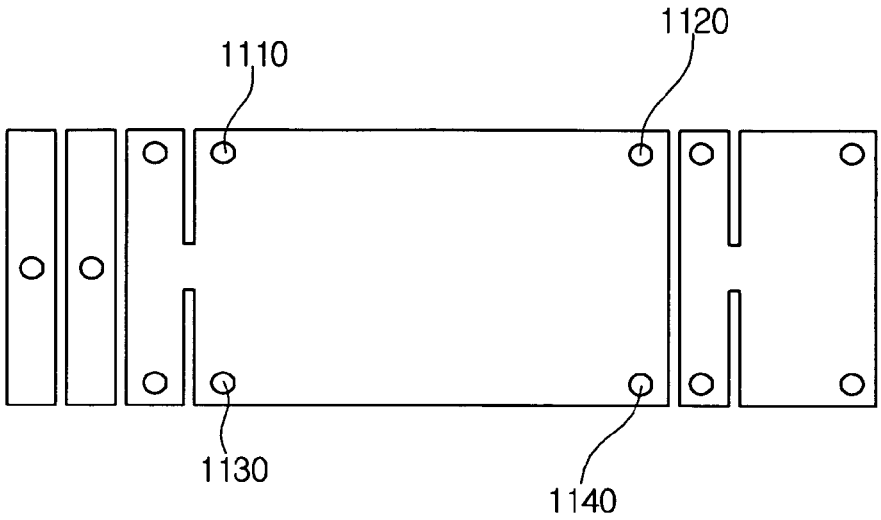
FIGS. 11*a* to 11*e* are plan views, development views, characteristic change graphs of upper and intermediate plane antennas according to a sixth embodiment of the present invention.
Figure 11B:
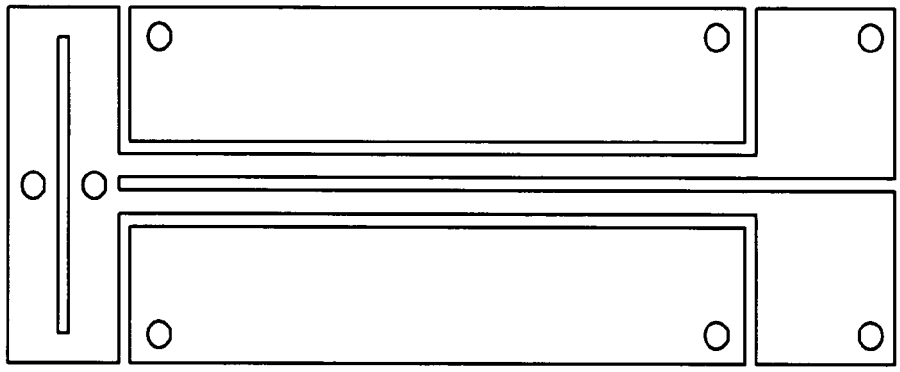
Figure 11C:
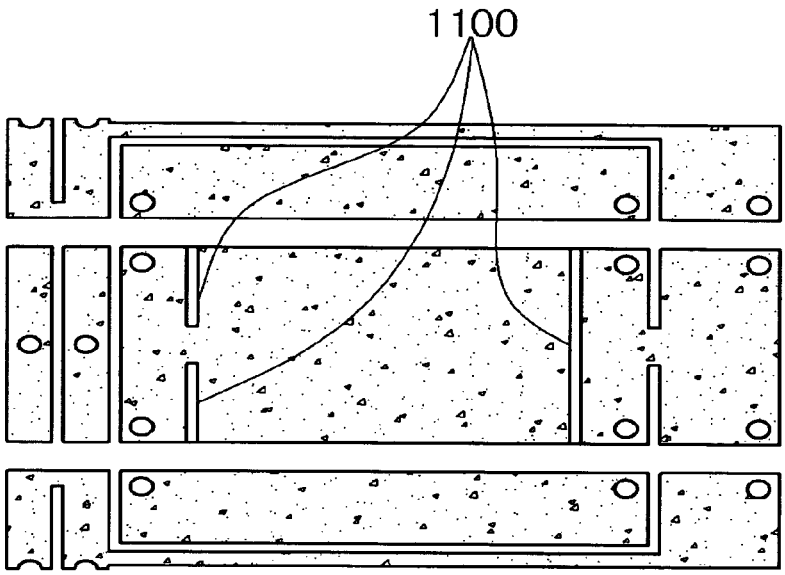

As shown in FIG. 11*a* to 11*c*, in the sixth embodiment, inverted-U shaped slots 1100 are added front and rear planes of the antenna as well as the upper plane antenna, while in the fourth embodiment an U-shaped slot is provided at the central portion of the U-shaped slot upper plane antenna. In addition, in order to use the front and rear planes of the antenna and electrically short-circuit the upper and intermediate plane antennas, a plurality of via holes 1110 to 1140 formed by puncturing the upper and intermediate plane antennas in a shape of a cylinder and plating an inner surface of the cylinder are added.

Figure 11D:
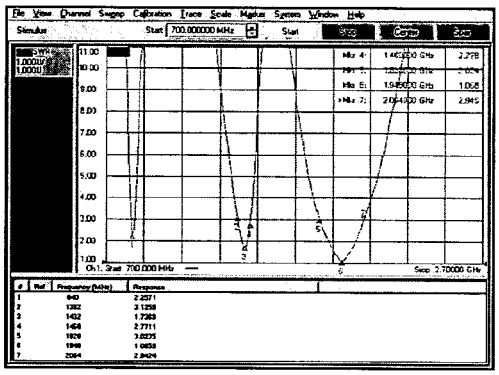
Figure 11E:
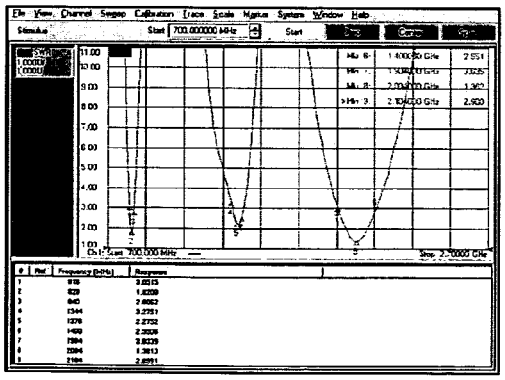

FIGS. 11*d* and 11*e* show changes of characteristics in the second embodiment. FIG. 11*d* shows characteristics of the antenna having a structure of FIG. 11*c*. FIG. 11*e* shows characteristics of the antenna where the upper and intermediate plane antennas of FIG. 101 exchanges positions thereof.

According to the present invention, it is possible to provide an antenna coping with miniaturization of mobile communication apparatuses. In addition, it is possible to provide an antenna available for a multiplexing service for simultaneously transmitting and receiving multi-channel information.

In addition, according to the present invention, since an antenna has two or more resonance frequencies and various tuning points, it is possible to select various resonance frequencies and tuning points. In addition, it is possible to obtain a good performance in all the resonance frequency bands and an omni-directional radiation pattern.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A multi-layered multi-band antenna used for a communication apparatus for a mobile communication service, comprising:

a PCB having power supply and ground portions;

an upper plane antenna separated from an upper plane of the PCB, the upper plane antenna consisting of a metal conductor having a predetermined pattern formed with a U-shaped slot;

an intermediate plane antenna interposed between the upper plane antenna and the PCB in parallel with the upper plane antenna, the intermediate plane antenna consisting of a metal conductor having a predetermined pattern formed with a U-shaped slot;

a power supply metal conductor having the one side connected to a power supply portion of the PCB and the other side connected to one side of the intermediate plane antenna;

a ground metal conductor having the one side connected to a ground portion of the PCB and the other side connected to one side of the intermediate plane antenna; and a plurality of short-circuiting metal conductors interposed between the upper and intermediate plane antennas to short-circuiting the upper and intermediate plane antennas.

2. The multi-layered multi-band antenna according to claim 1, wherein the plurality of short-circuiting metal conductors are inserted into a plurality of via holes formed at the upper and intermediate plane antennas to short-circuit the upper and intermediate plane antennas, and wherein a solid-state rectangular-parallelepiped dielectric member is interposed between the upper and intermediate plane antennas.

3. The multi-layered multi-band antenna according to claim 1, wherein the short-circuiting metal conductor include front and rear or left, and right short-circuiting conductors by folding the front and rear sides or the left and right sides of the upper plane antenna and short-circuiting the front and rear sides or the left and right sides thereof to the front and rear sides or the left and right sides of the intermediate plane antenna, and wherein an air layer is interposed between the upper and intermediate plane antennas.

4. The multi-layered multi-band antenna according to claim 2, wherein the intermediate plane antenna is formed by dividing the intermediate plane antenna into left and right intermediate plane antenna portions based on the power supply and ground metal conductors and coupling the left and right intermediate plane antenna portion, and wherein an impedance matching point is obtained by adjusting lengths of both side ends of the divided portions.

5. The multi-layered multi-band antenna according to claim 4, wherein, in the portions of the intermediate plane antenna to which the power supply and ground metal conductors are connected, a slot is connected to the intermediate plane antenna between the power supply and ground metal conductors, and wherein front or rear sides of the slot is connected to the intermediate plane antenna with a predetermined width.

6. The multi-layered multi-band antenna according to claim 5, wherein an inverted-U shaped slot is added to the power supply or ground metal conductor thereby inducing resonance in a multi-band or shifting resonance frequency in a high frequency band to low frequency.

7. The multi-layered multi-band antenna according to claim 5, wherein an H-shaped slot is added to a central portion of the upper plane antenna.

8. The multi-layered multi-band antenna according to claim 5, wherein the intermediate plane antenna comprises a first metal conductor connected to the power supply metal conductor and having a relatively wide width, a second metal conductor connected to the first metal conductor and having a narrower width than the first metal conductor, and a third metal conductor connected to the second metal conductor and having a wider width than the second metal conductor, thereby inducing resonance in a low frequency band.

9. The multi-layered multi-band antenna according to claim 5, wherein the intermediate plane antenna comprises a first metal conductor connected to the power supply metal conductor and having a relatively narrow width, a second metal conductor connected to the first metal conductor and having a wider width than the first metal conductor, and a third metal conductor connected to the second metal conductor and having a narrower width than the second metal conductor, thereby inducing resonance in a low frequency band.

10. The multi-layered multi-band antenna according to claim 5, wherein the plurality of the power supply metal conductors are connected to the upper and intermediate plane antennas, thereby simultaneously supplying power to the intermediate plane antenna.

* * * * *